US008479444B2

(12) United States Patent
Mesiara

(10) Patent No.: US 8,479,444 B2
(45) Date of Patent: Jul. 9, 2013

(54) VERTICAL GARDEN ASSEMBLY

(76) Inventor: Gislene Medeiros Mesiara, São Paulo (BR)

( * ) Notice: Subject to any disclaimer, the term of this patent is extended or adjusted under 35 U.S.C. 154(b) by 91 days.

(21) Appl. No.: 13/129,761

(22) PCT Filed: Aug. 14, 2009

(86) PCT No.: PCT/BR2009/000268

§ 371 (c)(1),
(2), (4) Date: May 17, 2011

(87) PCT Pub. No.: WO2010/054450

PCT Pub. Date: May 20, 2010

(65) Prior Publication Data

US 2011/0258929 A1 Oct. 27, 2011

(30) Foreign Application Priority Data

Nov. 13, 2008 (BR) ..... 8802729 U

(51) Int. Cl.
*A01G 9/02* (2006.01)

(52) U.S. Cl.
USPC ..... 47/83; 248/27.8

(58) Field of Classification Search
USPC ..... 248/27.8, 175; 211/85.23, 88.03, 211/94.01, 106, 86.01, 87.01; 47/1.01 S, 47/39, 44–47, 65.5, 66.6, 66.7, 67, 70, 83
See application file for complete search history.

(56) References Cited

U.S. PATENT DOCUMENTS

| | | | | | |
|---|---|---|---|---|---|
| 3,935,671 | A | * | 2/1976 | Soot | 47/70 |
| D247,751 | S | * | 4/1978 | Appleby | D25/45 |
| 4,499,688 | A | * | 2/1985 | Droll | 47/83 |
| 4,612,300 | A | | 9/1986 | Coleman | |
| 5,269,095 | A | * | 12/1993 | Helfman et al. | 47/65.5 |
| 6,003,824 | A | | 12/1999 | Peterson et al. | |
| 2004/0093792 | A1 | * | 5/2004 | Avery | 47/47 |

FOREIGN PATENT DOCUMENTS

| | | | |
|---|---|---|---|
| BR | MU8502530 | | 8/1985 |
| CN | 201042146 | | 4/2008 |
| DE | 3531515 | A1 * | 3/1987 |
| JP | 2005270052 | | 10/2005 |
| JP | 2007274948 | | 10/2007 |

OTHER PUBLICATIONS

International Search Report for PCT/BR2009/000268.
Written Opinion of the Searching Authority for PCT/BR2009/000268.

* cited by examiner

*Primary Examiner* — Rob Swiatek
*Assistant Examiner* — Ebony Evans
(74) *Attorney, Agent, or Firm* — B. Aaron Schulman, Esq.; Stites & Harbison PLLC

(57) ABSTRACT

A vertical garden assembly, concerned with the field of gardening, more precisely for use in the decoration of internal and external environments by means of adequately suspended vases, to which an original constructive arrangement is given, aiming to reach a different functional option from the models previously developed by the inventor.

5 Claims, 7 Drawing Sheets

VERTICAL GARDEN ASSEMBLY

FIELD OF THE INVENTION

The present invention refers to a vertical garden assembly, concerned with the field of gardening, more precisely for use in the decoration of internal and external environments by means of adequately suspended vases, to which an original constructive arrangement is given.

BACKGROUND OF THE INVENTION

Most houses, offices and stores are currently ornamented with some kind of plant or natural foliage, so as to offer peacefulness and naturalness to internal or external environments. As known, especially by landscapers and decorators, the most widely used and preferred model to arrange plants in such environments is a suspending support, especially to keep the floor area free for transit.

Ornamental plants are put in vases made of certain tree ferns or clay containing soil, which are later housed in supports, generally a plastic base similar to a "plate with wings", from which side chains are joined to a ring, which is then hung to hook at the end of a shaft. One of the main inconveniences of said models is, first of all, the fact that most vases and devices inconveniently occupy useful spaces in corridors, rooms and others, frequently with limitations in their free space.

Furthermore, most devices require water reservoirs, which have become a public health problem for creating a favorable environment to the appearance of dengue mosquito larvae and offering easy access and a favorable environment to the reproduction of dipterans. Furthermore, it is common sense that the use of ornamental plants and their aesthetically impression to decorative trends should not be suppressed.

From the above verifications, what is needed therefore is a support for plants, whose constructive arrangement is applied to a vertical structure, fixed in place by means of a screwed support, optionally being peripherally and orthogonally provided with projecting laterals (with relation to the vertical structure), rectangular on its front side, circular or with another geometrically regular or irregular shape as more appropriate to the space where it is introduced, with the vertical flat structure containing a frame over the perimeter of the projecting lateral.

SUMMARY OF THE INVENTION

The present invention seeks to provide a vertical garden assembly, comprising: (a) an assembly (1) fixed to a vertical flat structure (2), the assembly including: (a1)) a screen (3), formed by horizontal (4) and vertical (5) rigid wires, rectangularly fixed to one another, and having 4 vertexes and a central region; (a2) multiple perforated L-shape projections (6), fixed to the vertexes and to the central region, of the horizontal (4) and vertical (5) rigid wires; (a3) multiple vases (7), having: (a3.1) a front and a back perimeter, the back perimeter having one or two L-shape wings (8), the wings having an upper side perpendicular to the vertical flat structure (2) and attached to the vases, a central side parallel to the vertical flat structure (2), and a lower side perpendicular to the vertical flat structure (2), having an end and of a length shorter than the upper side and defining an accessible gap, the parallel side including central rectangular holes (9) and the lower side provided with locking projections (10) at the end, and (a3.2) an upper end an a lower end, the lower end having multiple holes (11); wherein, the vases are attached to the screen (3) by means of the L-shape wings (8), and (a4) multiple water collecting elements comprising trapezoidal base (13), having lateral and frontal perimeters; a rim (14) along the lateral and frontal perimeters; the base further having multiple support pins (12), constructed and arranged to be fitted into multiple holes (11); wherein, the water collecting elements directing water percolated through the holes (11) of the vase (7) to the lower end region of the vase (7), to the screen (3), after spraying over a plant.

DETAILED DESCRIPTION OF THE INVENTION

Figure 1:
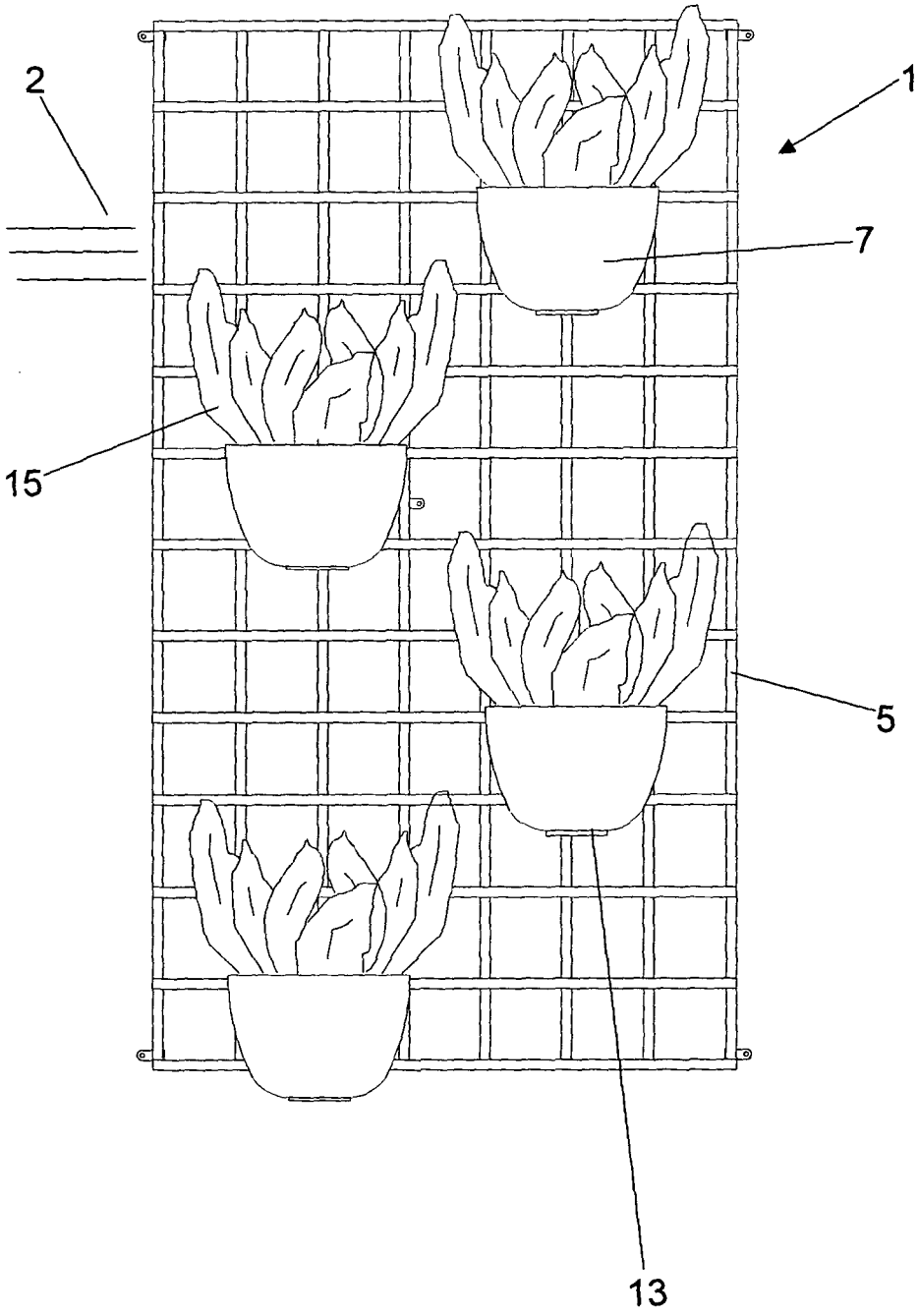
FIG. 1 shows a front view of the assembly of vertical support and vases, showing the frontal arrangement of vases containing plants.
Figure 2:
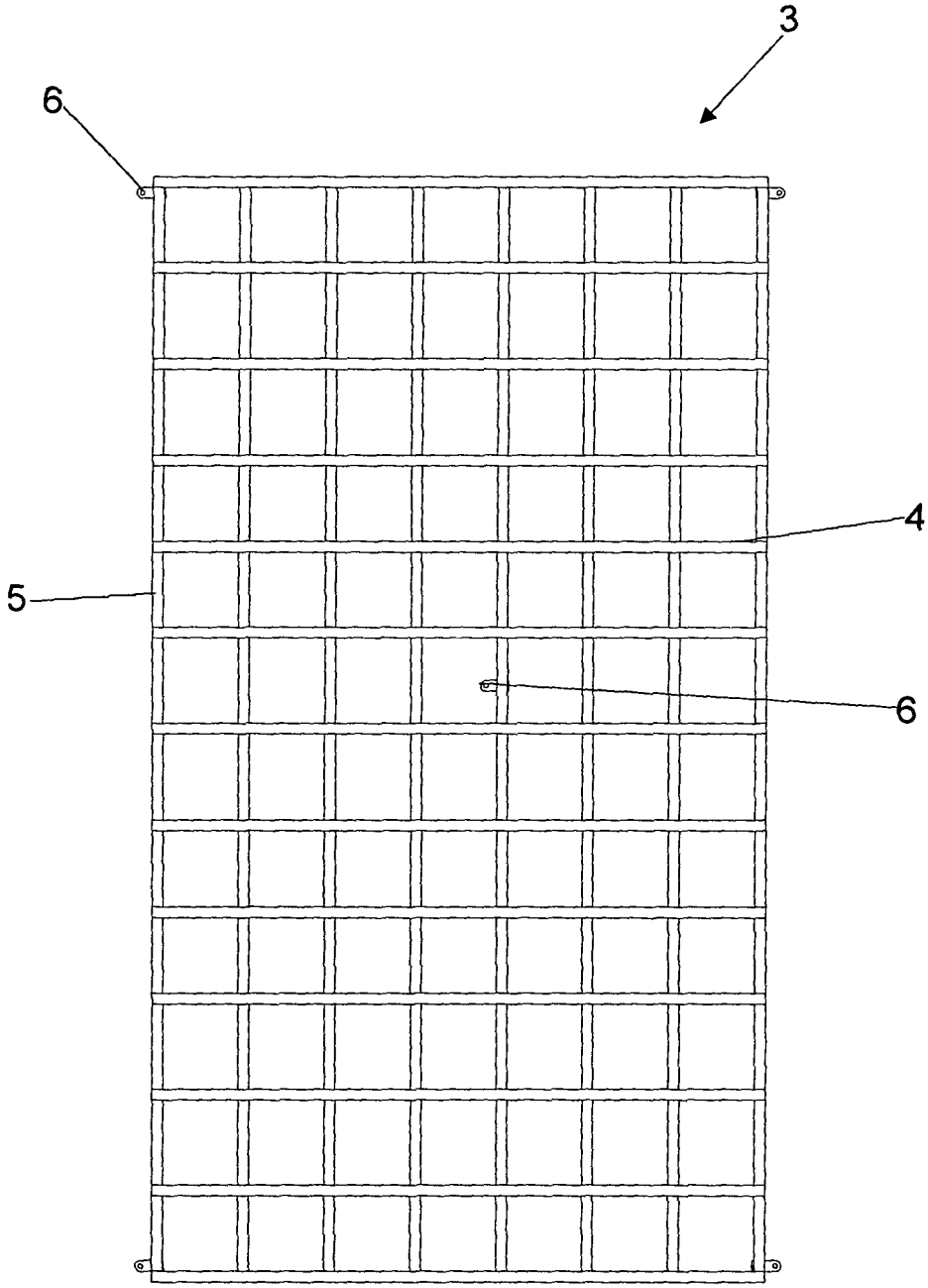
FIG. 2 shows a front view of the vertical support, showing its structure and the location of the perforated L-shape projections.
Figure 3:
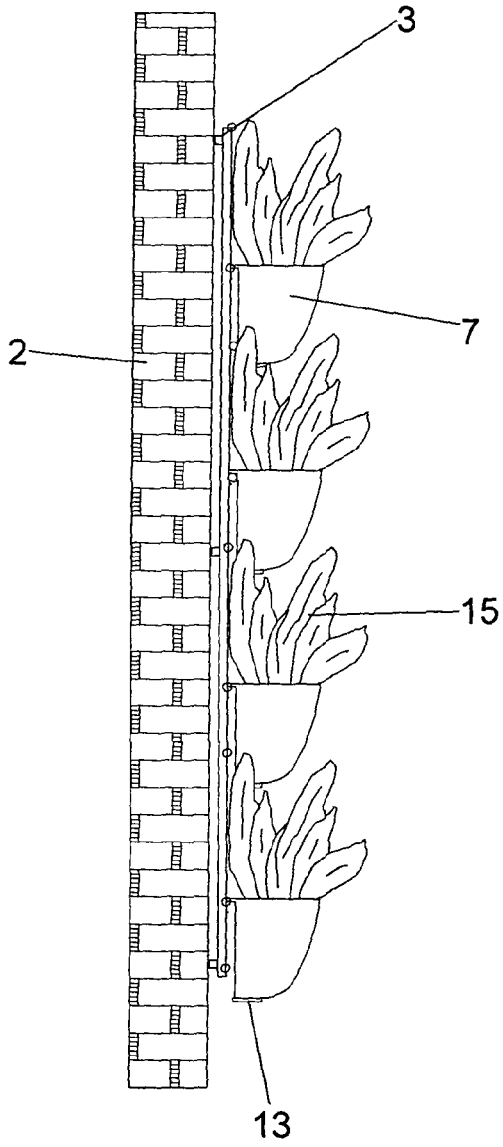
FIG. 3 shows a side view of the assembly of vertical support and vases, showing the final arrangement of vases containing plants.
Figure 4:
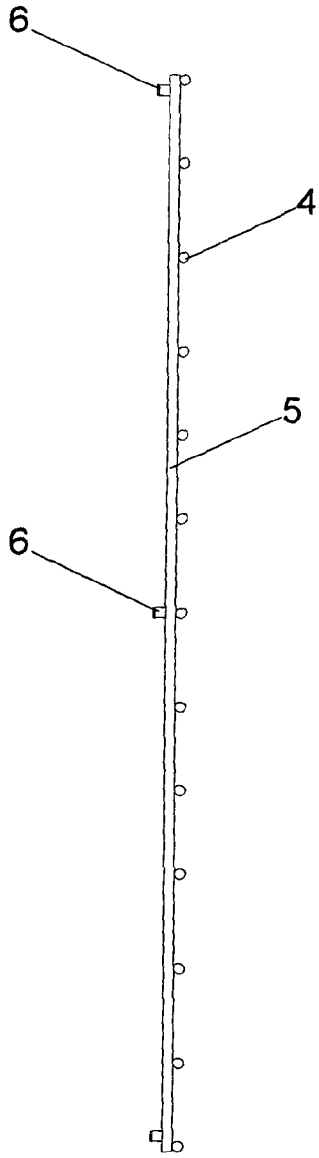
FIG. 4 shows a side view of the vertical support.
Figure 5:
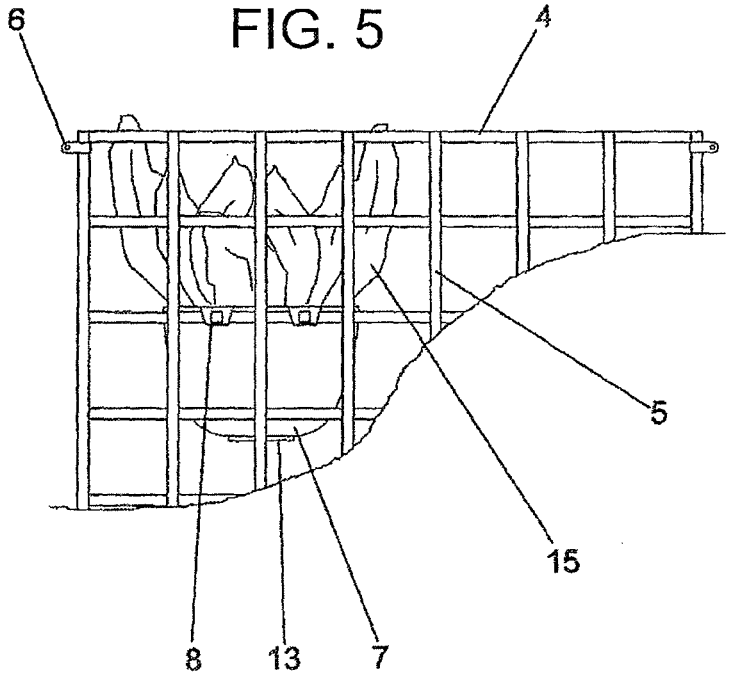
FIG. 5 shows a partial end view of the assembly of vertical support and vases, showing the fitting of L-shape wings as contained in the vase over one of the horizontal rigid wires of the screen.
Figure 6:
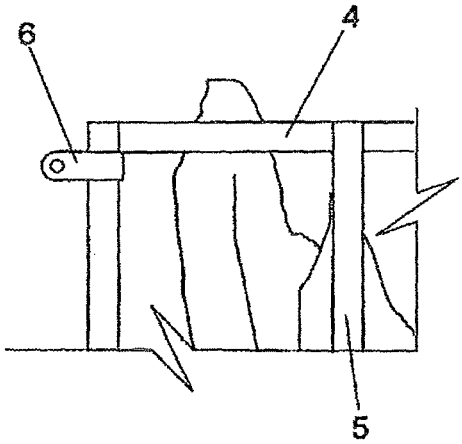
FIG. 6 shows an enlarged partial front view of the vertical support, showing the arrangement of one of the perforated L-shape projections contained in the vertex of the support.
Figure 7:
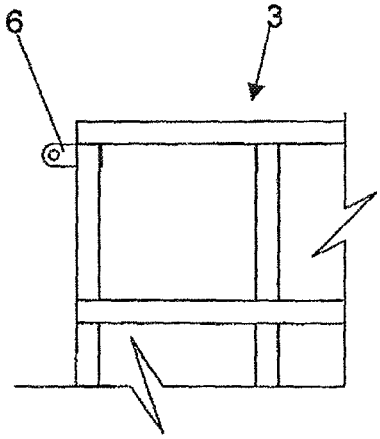
FIG. 7 shows an enlarged partial end view of the assembly of vertical support and vases, showing one of the perforated L-shape projections of the support positioned in the end region of the vertical rigid wires of the screen, near the vertex.
Figure 6A:
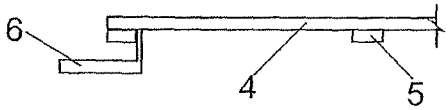
FIG. 6*a* shows an enlarged partial upper view of the vertical support, showing the arrangement of one of the perforated L-shape projections contained in the vertex of the support.
Figure 7A:
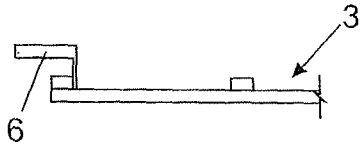
FIG. 7*a* shows an enlarged partial upper view of the assembly of vertical support and vases, showing one of the perforated L-shape projections of the support positioned in the end region of the vertical rigid wires of the screen, near the vertex.
Figure 8:
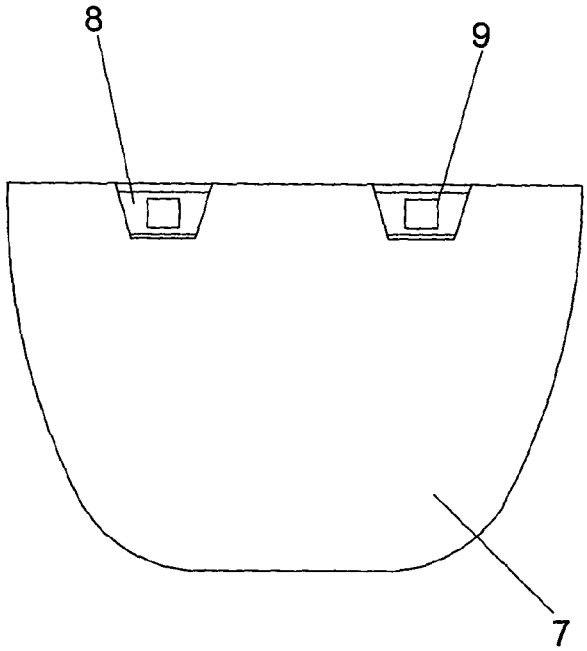
FIG. 8 shows an end view of the vase, showing fixing L-shape wings.
Figure 9:
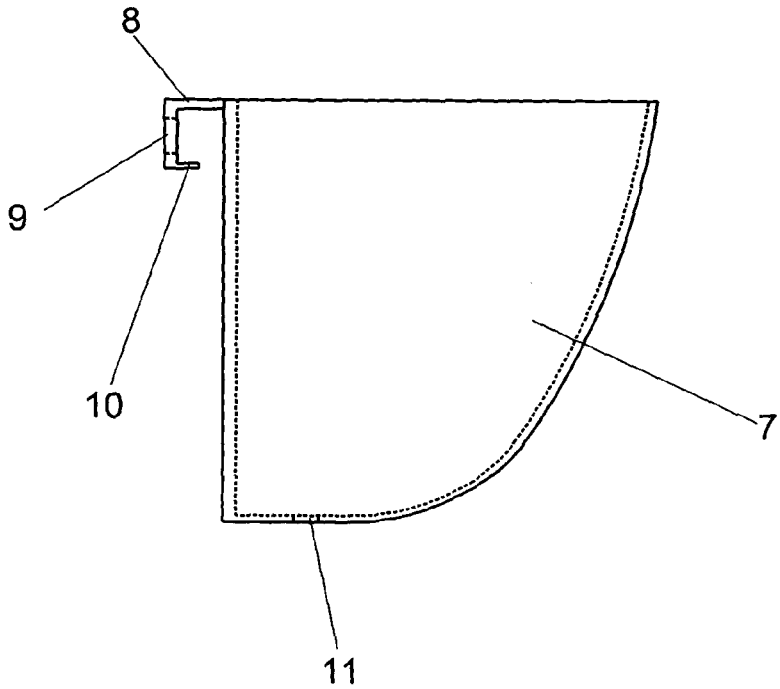
FIG. 9 shows a side cut view of the vase, showing the fixing L-shape wings.
Figure 10:
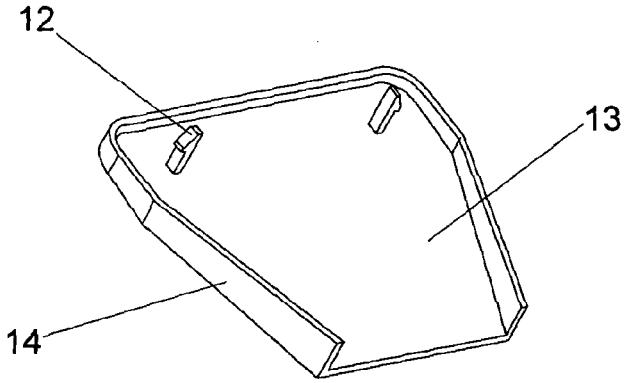
FIG. 10 shows a perspective view of the water pathway.
Figure 11:
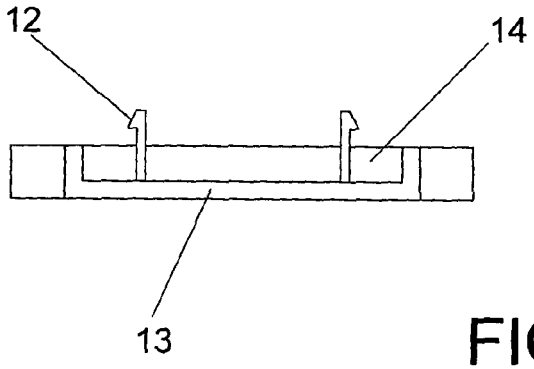
FIG. 11 shows an end view of the water pathway.
Figure 12:
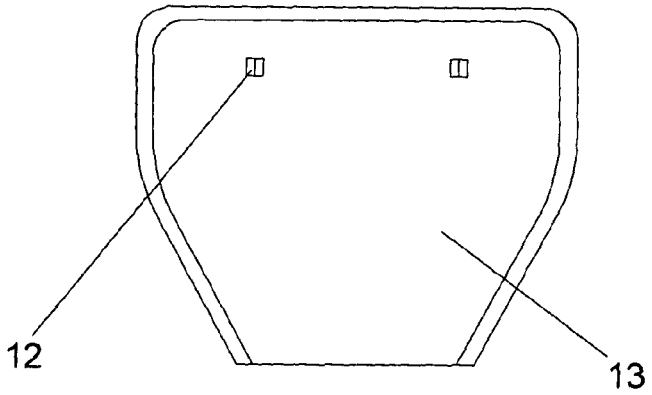
FIG. 12 shows an upper view of the water pathway.
Figure 13:
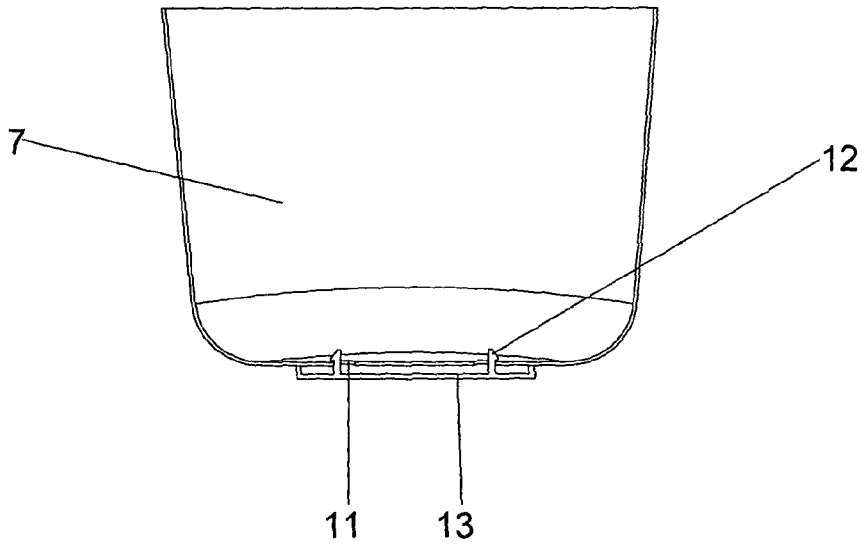
FIG. 13 shows a crosswise cut end view of the vase linked to the water pathway, showing the fitting of the support pins to the holes of the vase.
Figure 14:
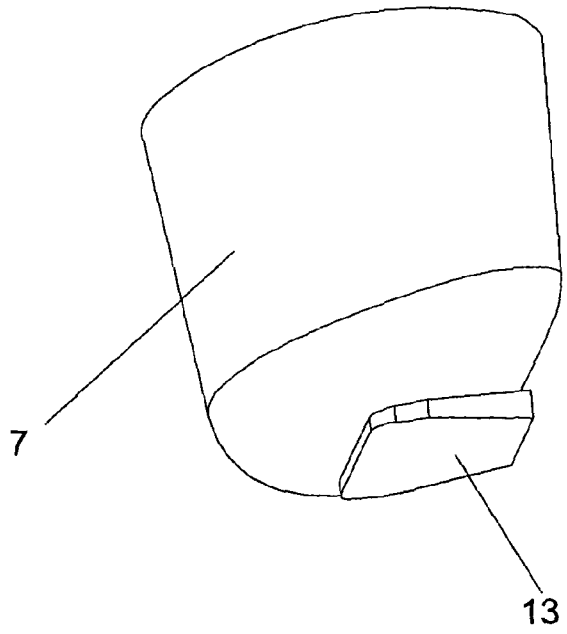
FIG. 14 shows a perspective lower side view of the vase with the water pathway.

This is a complementary landscape solution for vertical gardens, allowing the safe and functional hanging suspension of vases for plants in a wide range of shapes and types. Therefore, the present invention is designed and developed to reach a widely practical solution bringing in a range of advantages, both in its use and manufacture, not requiring any knowledge beyond already existing gardening skills for the use of the present arrangement, since plants, as planted in the vases connected to the support, may be vertically located on walls, not requiring the use of chains or apparent metal structures.

Another object of the present application is an improvement applied to an assembly for vertical gardens with low cost for its industrial viability, allied to the requirements of strength, safety and practical use, thus offering the consumer an additional option in the market that presents similar products.

The present disposition was developed incorporating an automatic irrigation system by means of a pressure pump installed within a frame, so as to provide the fall of water throughout a fiber panel that contained the plants, thus eliminating the need for manually water the plants. However, concerning arrangements in the form of vases, plastic base supports suspended by chains are still used and, besides their ugly appearance, they do not allow a different and more versatile arrangement of the plants without the inconvenient and troublesome use of various kinds of supports.

From the perception of this need, the present invention seeks to provide other supports for plants, applicable to a vertical flat structure, internally provided with a plate, wire net or even screen, evolving to an assembly provided with other improvements to solve a few limitations, among which can be highlighted: the need to safely lock the vase to the support, the possibility to install the supports in modules, to fix the support with a given distance from the wall, among others.

The present vertical assembly for gardens, conceived from the construction of a support in the shape of a quadrangular screen, preferably from rigid maritime grade aluminum wires, which are intertwined or welded, and with black electrostatic covering, at whose vertexes perforated L-shape projections are provided with appropriate spacing to fix the support to walls and panels, by means of stainless steel screws. Said spacing aims to avoid the occurrence projections and dripping of water directly to the wall, causing undesired infiltrations.

Various trapezoidal/ellipsoidal vases are hung on the wires, preferably of polymer containing black pigment and with a grade of protection against UVA and UVB rays, provided on their back part with L-shape wings with one or two locking projections, able to fit into the back screen and keep the vases completely stable and fixed against the occurrence of winds.

Therefore, the user may place and remove the vases from the back screen with no need to release any kind of fixing element. In other particular aspect, the present arrangement allows fixing the vases so as to keep them from being taken by thieves or vandals, when installed in places with free public access. Furthermore, the maintenance of plants is easily performed, since it does not require the back plate, or all vases at the same time to be taken off the wall. It is optional to use an automated irrigation system to make the irrigation of the plants easier.

This Application uses, with no limitation to only this alternative, the black color for elements forming the assembly and also as a background color for the surfaces covered by the vertical garden, to create the aesthetical effect of an infinite background. This detail is important when the vertical garden is in use, when possible failure in vegetation coverage cannot be easily seen. It is also important to remark that the preferable materials are not perishable and are resistant to weather conditions, such as maritime grade aluminum with black electrostatic covering and plastic with UVA and UVB protection aiming to reach longer use of the assembly. Another advantage of the present invention refers to the easy disassembly and re-assembly of the structure, which is a novel condition in the conception of vertical gardens, offering cost savings and practical use to the consumer, who can re-use all parts of the vase arrangement. On the other hand, vase mobility allows creating various geometrical patterns, not requiring the vases to be symmetrically distributed, since the back screen allows the free movement of the vase L-shape wings along various points on the screen.

Furthermore, the present arrangement allows the use of a water deviation element coupled to the bottom of the vase, keeping the water percolated through the vase holes from being directed to inside of the subsequent vase. This detail matters in cases where plants with different water requirements are used, i.e. to avoid the water percolated from vases with plants which are more frequently watered going to plants requiring water less frequently.

Therefore, the present arrangement results in an assembly with unique characteristics, obtained from an appropriate manufacturing design concept.

Since said constructive arrangement shows the beauty and ornamental versatility of plants, occupying only limited space, it is possible to use vegetal decoration with a wide range of species and kinds of plants and flowers, appropriately ornamenting ambiences with restricted internal space, also making use of beams, columns and walls with narrow or small dimensions.

Preferably conceived in black color and applied to duly waterproofed surfaces, also in black color, the assembly is discreet, non reflexive and almost imperceptible when the vases are placed with less spacing.

Therefore, the present assembly for vertical gardens has been designed aiming to employ the lowest possible number of parts, conveniently configured and arranged to perform its functions with unique efficiency and versatility.

The present invention presents a practical and innovative improvement in a support for plant decoration, thus allowing a widely variety of uses. Its innovative shape allows to reach an excellent functional level, offering high durability and versatility, having been mainly created to provide better fixing of the plants, more stability of the vases against winds and a freeing distance from the occurrence of humidity in the region where the back screen is fixed The vertical garden assembly of the present application is extremely easily built, easily manufactured, with excellent practical and functional results, thus offering an innovative conception over known models.

In the present invention, an assembly (1) is directly fixed to a wall (2) or a vertical flat structure by means of screws, is previously waterproofed by means of an asphalt blanket and/or polymeric mortar in black color, besides collecting elements for the exudation or wetting water.

The assembly (1) is formed by a quadrangular screen (3) constituted by rigid horizontal (4) and vertical (5) wires of maritime grade aluminum rectangularly welded to themselves, forming two layers, subsequently covered with electrostatic painting, provided with perforated L-shape projections (6), fixed to the vertexes and to the center, over the vertical rigid wires (5).

Horizontal rigid wires (4) located throughout the screen support trapezoidal/ellipsoidal vases (7), by means of one or two L-shape wings (8), in solidarity to their back part, containing central rectangular holes (9) and provided with locking projections (10) at their ends.

Trapezoidal/ellipsoidal vases (7) are typically made of a polymer resistant to UVA and UVB, radiation, having holes (11) at their lower ends, and inside, where support pins (12) of a trapezoidal base (13) are fitted, said base provided with rims (14) around the lateral and frontal perimeter. Said configuration has the purpose to deviate percolated water from inside the vase (7), after being sprinkled over the plants (15) therein, manually or by an automated temporized system. Said water excess projecting through the holes drips within the trapezoidal base (13), directing it to the lower end region of the vase (7), on the plane of the quadrangular screen (3), avoiding dripping and running out through its bottom.

Despite the disclosure for the above intended mode, it will be evident for the person skilled in the art that changes in the assembly may be made, not escaping from the spirit and scope of the invention, as well defined in the attached claims.

The invention claimed is:

1. A vertical garden assembly, comprising:

(a) an assembly fixed to a vertical flat structure, the assembly including:

(a1) a screen, formed by horizontal and vertical rigid wires, rectangularly fixed to one another, and having 4 vertexes and a central region;

(a2) multiple perforated L-shape projections, fixed to the vertexes and to the central region, of the horizontal and vertical rigid wires;

(a3) multiple vases, having:

(a3.1) a front and a back perimeter, the back perimeter having one or two L-shape wings, the wings having an upper side perpendicular to the vertical flat structure and attached to the vases, a central side parallel to the vertical flat structure, and a lower side perpendicular to the vertical flat structure, having an end and of a length shorter than the upper side and defining an accessible gap, the parallel side including central rectangular holes and the lower side provided with locking projections at the end, and (a3.2) an upper end and a lower end, the lower end having multiple holes;

wherein, the vases are attached to the screen by means of the L-shape wings, and (a4) multiple water collecting elements comprising trapezoidal bases, having lateral and frontal perimeters; a rim along the lateral and frontal perimeters; each base further having multiple support pins, constructed and arranged to be fitted into multiple holes;

wherein, the water collecting elements direct water percolated through the holes of the vases to the lower end regions of the vases, to the screen, after spraying over a plant.

2. The vertical garden assembly according to claim 1, wherein the vertical flat structure is a wall.

3. The vertical garden assembly according to claim 1, wherein the assembly is previously waterproofed by a means selected from a group consisting of: an asphalt blanket and a polymeric mortar.

4. The vertical garden assembly according to claim 1, wherein the vases are of a shape selected from the group consisting of: trapezoidal and ellipsoidal.

5. The vertical garden assembly according to claim 2, wherein the L-shape projections are provided with appropriate spacing to fix the screen to the vertical flat structure, by means of stainless steel screws, avoiding the dripping of water directly to the vertical flat structure.

* * * * *